United States Patent [19]

Brezosky

[11] 4,320,614

[45] Mar. 23, 1982

[54] PANEL ASSEMBLY FOR SHEET METAL PANELS HAVING DOUBLE WALL CONSTRUCTION CORNERS

[75] Inventor: Bernard J. Brezosky, Louisville, Ky.

[73] Assignee: General Electric Company, Louisville, Ky.

[21] Appl. No.: 110,057

[22] Filed: Jan. 7, 1980

[51] Int. Cl.[3] ..... E04C 2/32

[52] U.S. Cl. ..... 52/630; 52/288; 52/716; 52/829

[58] Field of Search ..... 52/829, 830, 630, 783, 52/784, 656, 288, 716; 29/155 R, 453; 312/137, 257 SK

[56] References Cited

U.S. PATENT DOCUMENTS

| | | | |
|---|---|---|---|
| 1,233,497 | 7/1917 | Ohnstand | 52/829 |
| 2,549,414 | 4/1951 | Bornell | 52/783 |
| 2,681,261 | 6/1954 | Blink | 52/829 |
| 3,219,401 | 11/1965 | Mapson | 52/783 |

FOREIGN PATENT DOCUMENTS

| | | | |
|---|---|---|---|
| 512067 | 8/1939 | United Kingdom | 52/829 |

*Primary Examiner*—Price C. Faw, Jr.
*Assistant Examiner*—H. E. Raduazo
*Attorney, Agent, or Firm*—Radford M. Reams

[57] ABSTRACT

A panel assembly comprising a panel with at least one double wall construction corner having a cut-away corner formed by the removal of a portion of the panel at the intersection of the corner forming walls, and a molded plastic snap-in corner plug which is inserted in the cut-away corner to substantially fill the corner, providing a smooth transition surface across the corner, the transition surface being shaped to provide the desired corner contour; and a method of fabricating such a panel assembly.

6 Claims, 5 Drawing Figures

PANEL ASSEMBLY FOR SHEET METAL PANELS HAVING DOUBLE WALL CONSTRUCTION CORNERS

BACKGROUND OF THE INVENTION

This invention relates to a panel assembly for providing smooth corners in double wall, sheet metal panels.

Double panel walls formed from sheet metal are used extensively in cabinets for home appliances and for desk drawers and cabinet doors and other items of home and office furniture. Typically, the forming of a double wall construction corner results in a jagged or sharp edge at the intersection of the side walls of the sheet metal panel. The seam at this intersection then may be closed by welding and burrs are removed and the corners smoothed by a grinding process. It is desirable to provide a panel having corners of double wall construction having smooth corners which are easily fabricated without operations such as the welding and grinding steps.

It is therefore an object of the present invention to provide a sheet metal panel assembly for a panel having at least one corner of double wall construction, which is smoothly contoured without welding and grinding to finish the corners.

It is a further object of the present invention to provide a method for fabricating a sheet metal panel of double wall construction in which smooth corners are provided without metallurgically closing the corner seams and without the need for grinding to finish the corner.

SUMMARY OF THE INVENTION

The panel assembly of the present invention comprises a panel having at least one corner of double wall construction, that is, having an outer wall and an inner wall and adjacent side walls substantially spanning the space therebetween to form a corner. A portion of the panel is removed at the intersection of the side walls to form a cut-away corner. An integrally molded corner plug is inserted in the cut-away corner to substantially fill the cut-away corner and provide a smooth transition surface across the corner. This corner plug has an enlarged exterior body portion with an appearance surface shaped to provide the desired corner contour. An interior shank portion of reduced cross section projects through the cut-away corner. A pair of resilient ears project from opposite sides of the shank portion and engage the interior surfaces of corresponding side walls to retain the plug in the cut-away corner. The exterior body portion includes shoulders formed at the intersection of the shank portion and the body portion. These shoulders conform to the cut-away corner when the plug is seated in the cut-away corner.

The method of fabricating a panel having at least one corner portion of double wall construction in accordance with the invention comprises the steps of removing a portion of a metal sheet at the intersection of two adjacent edges; bending the sheet to form a double wall corner such that the removed portion provides a cut-away corner; and inserting a corner plug into the cut-away corner substantially filling the cut-away corner.

DETAILED DESCRIPTION OF THE INVENTION

Figure 1:
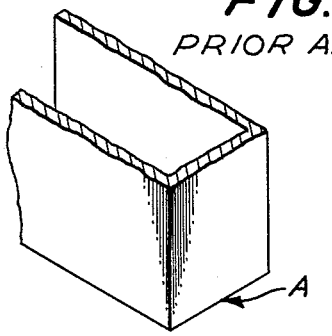
FIG. 1 PRIOR ART
FIG. 1 is a perspective view of a corner portion of a sheet metal panel having a corner of double wall construction representative of the prior art.

FIG. 1 shows a double wall construction corner portion of a sheet metal panel representative of the prior art. The edge designated A, formed by bending a metal sheet, is a sharp, open-seamed edge which after forming is normally welded along the seam to close the seam and then ground along the weld to remove burrs and to smooth the corner. The welding and grinding steps are costly and time consuming assembly steps.

Figure 2:
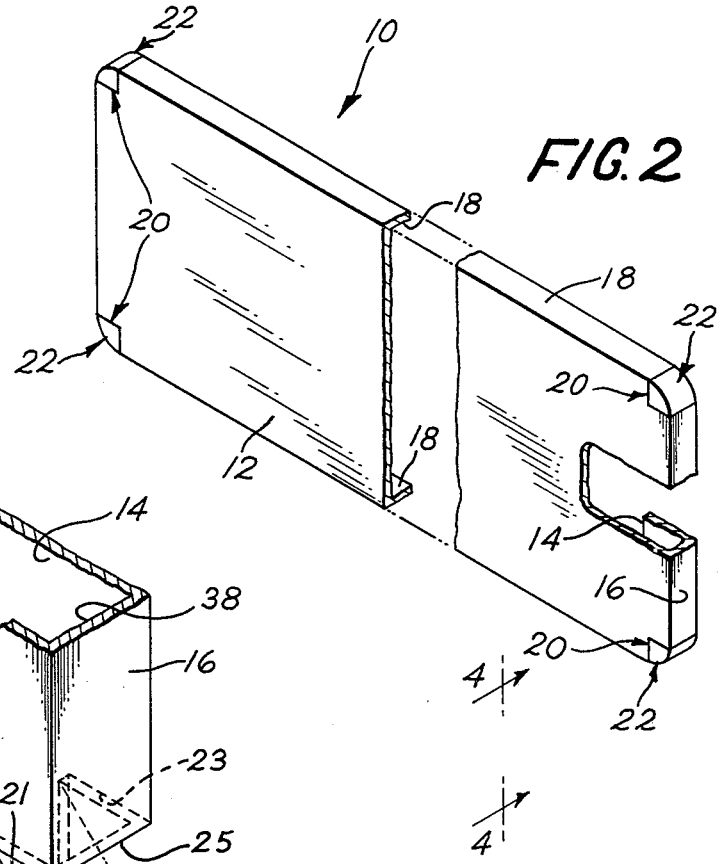
FIG. 2 is a perspective view, with portions cut away, of a sheet metal panel having corners of double wall construction incorporating an illustrative embodiment of the panel assembly of the present invention.
Figure 3:
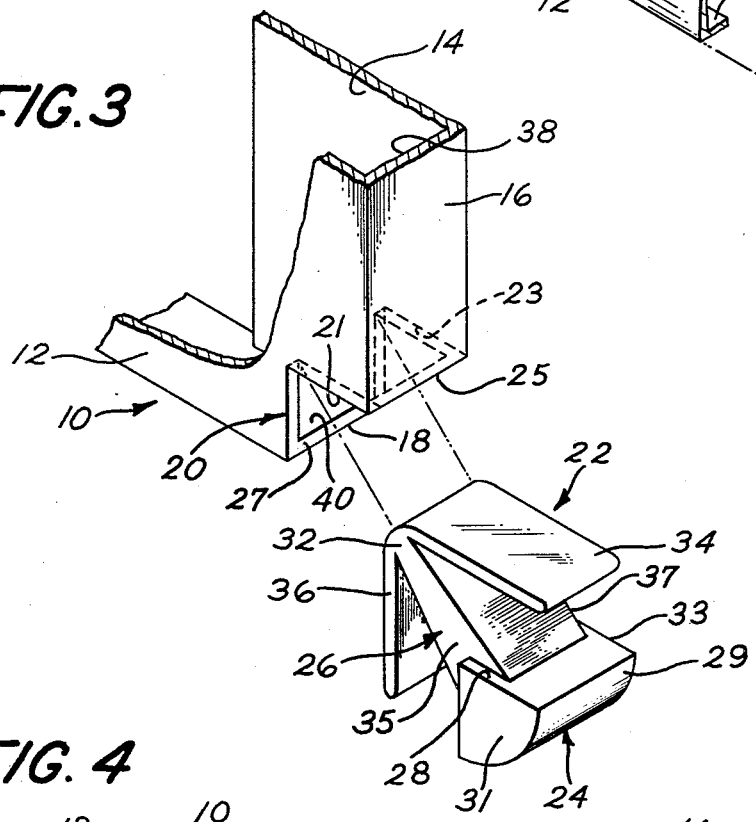
FIG. 3 is an exploded perspective of one double wall construction corner portion of the panel assembly of FIG. 2 illustratively embodying the present invention.

FIG. 2 illustrates a panel assembly which, according to an illustrative embodiment of the present invention, includes smooth corners and does not require welding and grinding. A sheet metal panel 10 has an outer wall 12, an inner wall 14 substantially parallel to outer wall 12, and vertical side walls 16 and horizontal side walls 18 which substantially span the space between inner wall 14 and outer wall 12. In the illustrative embodiment, side walls 16 and inner walls 14 are formed by return bending panel 10 along its vertical edges to form a U-channel. Each of horizontal side walls 18 comprises a flange formed by bending panel 10 along its horizontal edges spanning the space between outer wall 12 and inner wall 14. Side walls 18 intersect side walls 16 to form corner portions of double wall construction. A portion of panel 10 is removed from each corner portion so that when the double wall corners are formed by bending the sheet metal, that part of the corner portion which would form the intersection of side walls 16 and 18 is removed providing panel 10 with a cut-away corner, designated generally 20, as best seen in FIG. 3. More specifically, the removed portion includes aligned corner portions of outer wall 12 and inner wall 14 and intersecting end portions of side walls 16 and 18. The contour of the resulting cut-away corner 20 is defined by edges 21 and 23 of outer wall 12 and inner wall 14, respectively, and edges 25 and 27 of side walls 16 and 18, respectively. Thus, in the illustrative embodiment, the double wall construction corner comprises a U-channel along one edge which intersects a flange along an adjacent edge. It is to be understood, however, that the double wall construction for the corner portions could be formed in many other ways such as by return bending U-channels along intersecting edges of panel 10, with the intersection of the U-channels either being overlapped or mitre cut to form the corner portion with a cut-away corner. The particular structure for the double wall construction corner is not critical to the invention provided that a cut-away corner is formed.

Similarly, the panel of the illustrative embodiment has four double wall construction corners, each incorporating the panel assembly of the present invention, however the number of corners in the panel is not a part of the invention. A full and complete understanding of the invention may be had by a consideration of a single corner. Thus, the balance of the description will be directed to one corner of the panel assembly of FIG. 2.

A snap-in corner plug 22 is received in each cut-away corner 20 substantially filling the cut-away corner and providing a smooth transition surface between adjacent side walls 16 and 18. As best seen in FIG. 3, the snap-in corner plug 22 of the illustrative embodiment is an integrally molded plastic part comprising an enlarged exterior body portion 24 and an interior shank portion 26 of reduced cross section projecting from body portion 24 through cut-away corner 20. A shoulder portion 28 conforming to the contour of cut-away corner 20 is formed at the intersection of enlarged body portion 24 and interior portion 26 for engaging edges 21, 23, 25 and 27 which define cut-away corner 20 to properly position plug 22 in the cut-away corner. Exterior body portion 24 includes an appearance surface 29 contoured to provide a smooth transition surface between adjacent side walls 16 and 18. In the illustrative embodiment, surface 29 is essentially of cylindrical contour to provide a rounded corner. It is to be understood that in accordance with the present invention the contour of surface 29 could be any desired shape. For instance, surface 29 could be planar or it could be substantially right angular.

In the illustrative embodiment, surfaces 31 and 33 of body portion 24 are flush with the exterior surfaces of outer wall 12 and inner wall 14, respectively, to provide smooth inner and outer wall surfaces. Surfaces 35 and 37 of shank portion 26 slidingly engage the interior surfaces of outer wall 12 and inner wall 14, respectively, to provide lateral stability for plug 22 when the plug is positioned in cut-away corner 20. It should be noted also that while in the illustrative embodiment the cut-away corner is of right angular contour, the cut-away corner could be a variety of other shapes without departing from the invention.

Figure 4:
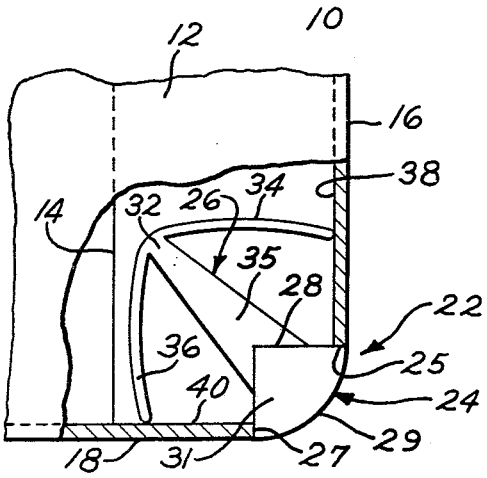
FIG. 4 is a view of one corner of the panel of FIG. 2 taken along line 4—4 with portions cut away.

Means for retaining plug 22 in cut-away corner 20 is provided in the illustrative embodiment in the form of a pair of ears 34 and 36 projecting from opposite sides of shank portion 26. Each of said ears projects from the distal end 32 of shank portion 26 at an acute angle relative to the shank. In the illustrative embodiment this angle is approximately 45°. As best seen in FIG. 4, when plug 22 is properly positioned in cut-away corner 20, ears 34 and 36 project toward corresponding side walls 16 and 18, respectively, to interferingly engage the interior surfaces 38 and 40 of said side walls 16 and 18, respectively, to limit the outward movement of the plug. Each of ears 34 and 36 is in abutting engagement with and substantially perpendicular to its corresponding side wall.

Figure 5:
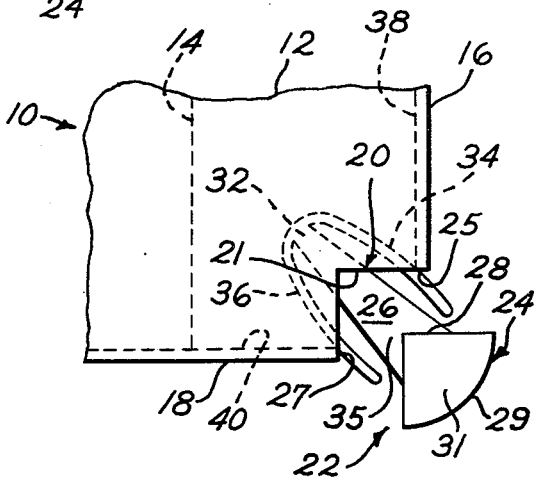
FIG. 5 is a front elevational view of a corner portion of a panel incorporating an illustrative embodiment of the panel assembly of the present invention showing the corner plug partially inserted to illustrate the assembly.

Ears 34 and 36 are resiliently movable toward shank portion 26 to facilitate insertion of the plug into the cut-away corner. A partially inserted plug is shown in FIG. 5. During insertion, ears 34 and 36 are moved toward shank 26 by engagement with edges 25 and 27 of side walls 16 and 18, respectively. Upon disengagement from edges 25 and 27, ears 34 and 36 expand toward their expanded position shown in FIG. 4. As shoulder 28 approaches cut-away corner defining edges 21, 23, 25 and 27, ears 34 and 36 are disengaged from edges 25 and 27 and move toward their expanded position substantially perpendicular to corresponding side walls 16 and 18, respectively. As ears 34 and 36 straighten, approaching their expanded position, they engage the interior surfaces 38 and 40 of walls 16 and 18, respectively, and tend to pull body portion 24 of plug 22 into corner 20 urging shoulder 28 into seating engagement with corner defining edges 21, 23, 25 and 27, and limiting outward movement of plug 22. Force applied to plug 22 in a direction tending to remove the plug from the cut-away corner is opposed by ears 34 and 36 which are in compression. Thus, ears 34 and 36 cooperate with shoulder 28 to seat plug 22 in cut-away corner 20 and are operative to retain plug 22 in its seated position shown in FIG. 4. It is to be understood that ears 34 and 36 need not necessarily be perpendicular to their corresponding side walls to retain plug 22 seated in the cut-away corner. It is necessary only that ears 34 and 36 engage their corresponding side walls to oppose the removing force. However, the substantially perpendicular arrangement is preferred, it being believed that this arrangement provides the maximum retaining force.

It is apparent from the foregoing description that the panel assembly of the present invention provides a panel having at least one corner of double wall construction in which a smooth corner is provided without need for welding and grinding to smooth the corner. In accordance with the present invention, the method for fabricating a sheet metal panel comprises the steps of removing a portion from at least one corner formed by the intersection of adjacent edges of the metal sheet to provide a cut-away corner-forming notch; bending the sheet metal along at least two adjacent edges forming the corner to form a corner section of double wall construction such that the removed portion forms a cut-away corner; and inserting a corner plug into the cut-away corner substantially filling the cut-away corner.

It will be appreciated that the panel assembly disclosed herein is merely illustrative and that the present invention may be advantageously employed in a wide variety of sheet metal panels having double wall construction corners. It is the inventor's intention in the claims which follow to cover all forms which fall within the spirit and scope of the invention as claimed.

What is claimed is:

1. A panel assembly comprising:

a panel having an outer wall, a substantially parallel inner wall and side walls along at least two adjacent edges of said panel, substantially spanning the space between said outer and inner walls; said panel having a portion removed at the point of intersection of said adjacent edges, the resultant exposed edges defining a cut-away corner; and a corner plug having an exterior body portion formed to substantially fill said cut-away corner and to provide a smooth transition surface between said adjacent side walls across said cut-away corner; and an interior portion comprising a shank portion projecting from said body portion through said cut-away corner into the interior region bounded by said inner, outer and side walls, and a pair of resilient ears projecting from opposite sides of said shank portion, the free end of each ear abuttingly engaging the interior face of the adjacent side wall, thereby limiting outward movement of said corner plug.

2. The panel assembly of claim 1 wherein said exterior body portion includes a shoulder portion conforming to the contour of said cut-away corner and engaging said cut-away corner defining edges, thereby positioning said corner plug in said cut-away corner.

3. The sheet metal panel assembly of claim 2 wherein each of said ears projects from the distal end of said shank portion at an acute angle relative to said shank.

4. The panel assembly of claim 2 wherein said ears are resiliently movable toward said shank portion for facilitating insertion of said plug into said cut-away corner.

5. The panel assembly of claim 4 wherein said resilient ears are operative when engaging said interior surfaces of said corresponding side walls to urge said shoulder portion toward said cut-away corner thereby cooperating with said shoulder portion to seat said plug in said cut-away corner.

6. The panel assembly of claim 2 wherein said shank portion slidingly engages opposed interior faces of said inner and outer walls to provide lateral stability for said corner plug.

* * * * *